US005622424A

United States Patent [19]

Brady

[11] Patent Number: 5,622,424

[45] Date of Patent: Apr. 22, 1997

[54] DECORATIVE NIGHT LIGHT WITH REPLACEABLE PHOTO HOLDER

[76] Inventor: Floyd W. Brady, 560 Hidden Valley Rd., Soquel, Calif. 94073

[21] Appl. No.: 590,229

[22] Filed: Jan. 23, 1996

[51] Int. Cl.[6] ..... F21V 33/00

[52] U.S. Cl. ..... 362/226; 362/95; 362/812; 40/765; D26/26

[58] Field of Search ..... 365/95, 226, 253, 365/806, 812; 40/716, 738, 765, 540; D26/26, 118

[56] References Cited

U.S. PATENT DOCUMENTS 3,694,648 9/1972 Yates ..... 40/716
4,878,162 10/1989 Wu ..... 362/226

*Primary Examiner*—Y. My Quach

*Attorney, Agent, or Firm*—Townsend and Townsend and Crew LLP

[57] ABSTRACT

A picture holder is disclosed for bayonet connection to a standard right angle wall plug mounted night light. An opaque frame is provided having a transparent convex outwardly exposed arcuate front wall with a defined frame periphery. A corresponding arcuate slot in the front top of the frame provides for insertion and removal of pictures to be displayed. A translucent backing is provided to the frame having an arcuate profile opposite and complimentary to the arcuate transparent profile of the transparent cover. The translucent backing has a profile to intimately surround the partial profile of the lamp to which the frame mounts. The frame with picture mounted can be inserted to the wall plug mounted bulb so that a first portion of the bulb is exposed to the enclosed interior of the frame and a second portion of the bulb is exposed to the wall of a wall mount plug immediately behind the frame. The frame includes as the base portion thereof the bayonet connection to the light.

3 Claims, 1 Drawing Sheet

DECORATIVE NIGHT LIGHT WITH REPLACEABLE PHOTO HOLDER

This disclosure relates to a mounted picture frame holder. More particularly, a mounted picture frame holder is disclosed which clips onto a standard night light, provides back lighting around the mounted picture, back illumination through the translucent portions of the mounted picture, all in a casing which is not subject to overheating.

BACKGROUND OF THE INVENTION

A so-called Night Light Assembly is disclosed in U.S. Pat. Nos. 4,549,250 and 4,714,984 both issued to Donald Spector. This assembly both holds a picture and provides for the display of a picture as well as the discharge of aromatic vapor due to the heat of the lamp. In Spector '984, the frame is assembled about the night light so as to encase the light completely.

Other representative state of the art patents include Love U.S. Pat. No. 3,598,986 issued Aug. 10, 1971 for TELEVISION AND NIGHT LIGHT (statue in front of illuminated background), Rochford et al. U.S. Pat. No. 3,818,213 issued Jun. 18, 1974 for CAST RESIN GLOW LAMP PRODUCT (distribution and emanation of light from cast covering), Rochford et al. U.S. Pat. No. 3,818,212 issued Jun. 18, 1974 for DECORATIVE GUIDE LIGHT (decorative article having distribution and emanation of light), and Martin FLAT FACE NIGHT LIGHT U.S. Pat. No. 4,344,116 issued Aug. 10, 1982 (plug in night light having flat face).

SUMMARY OF THE INVENTION

A picture holder is disclosed for bayonet connection to a standard right angle wall plug mounted night light. An opaque frame is provided having a transparent convex outwardly exposed arcuate front wall with a defined frame periphery. A corresponding arcuate slot in the front top of the frame provides for insertion and removal of pictures to be displayed. A translucent backing is provided to the frame having an arcuate profile opposite and complimentary to the arcuate transparent profile of the transparent cover. The translucent backing has a profile to intimately surround the partial profile of the lamp to which the frame mounts. The frame with picture mounted can be inserted to the wall plug mounted bulb so that a first portion of the bulb is exposed to the enclosed interior of the frame and a second portion of the bulb is exposed to the wall of a wall mount plug immediately behind the frame. The frame includes as the bottom thereof the bayonet connection to the light.

In operation, the frame is first provided with a picture and then mounted at the bayonet fitting to the bulb. The arcuate translucent backing exposes a first half of the bulb to the frame interior and a second half of the bulb to the wall immediately behind the frame. This partial covering of the bulb provides uniform illumination to standard photographs inserted within the frame while casting an attractive light halo around the mounted frame to provide both a translucently illuminated photograph and attractively mounted back lit picture frame.

DESCRIPTION OF THE PREFERRED EMBODIMENT

Figure 1:
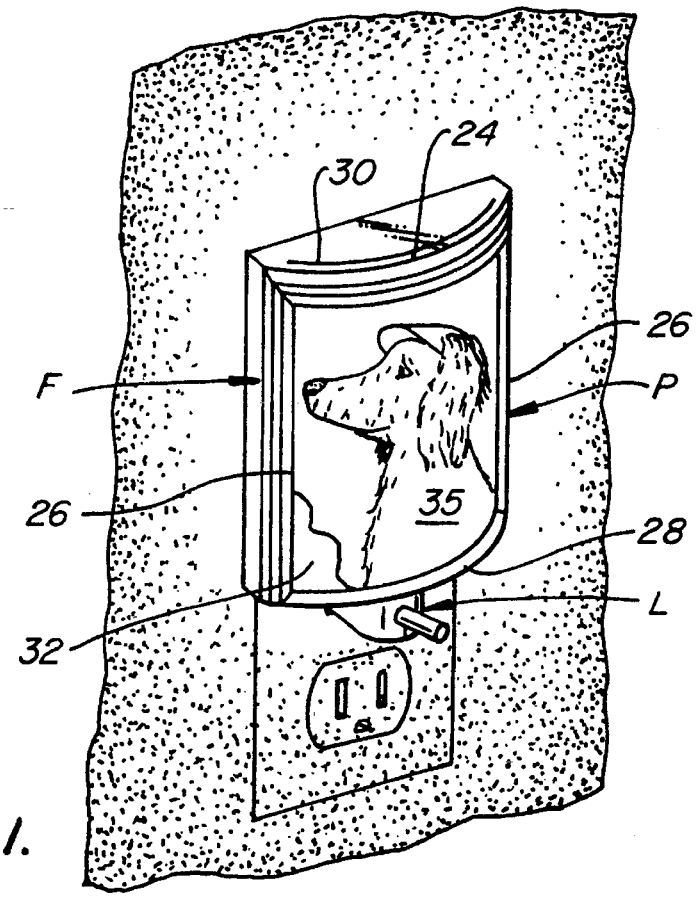
FIG. 1 is a perspective view of the light and frame of this invention mounted to a wall plug with a picture displayed within the lighted unit and indicating schematically the halo effect about the frame produced by the directly exposed right angle mounted bulb; and, FIG. 2 is an exploded view of the standard right angle mounted wall plug having the removeably detachable frame and bayonet attachment with the translucent backing having the bulb profile to enable simultaneous illumination of the mounted picture as well as back lighting of the frame profile.
Figure 2:
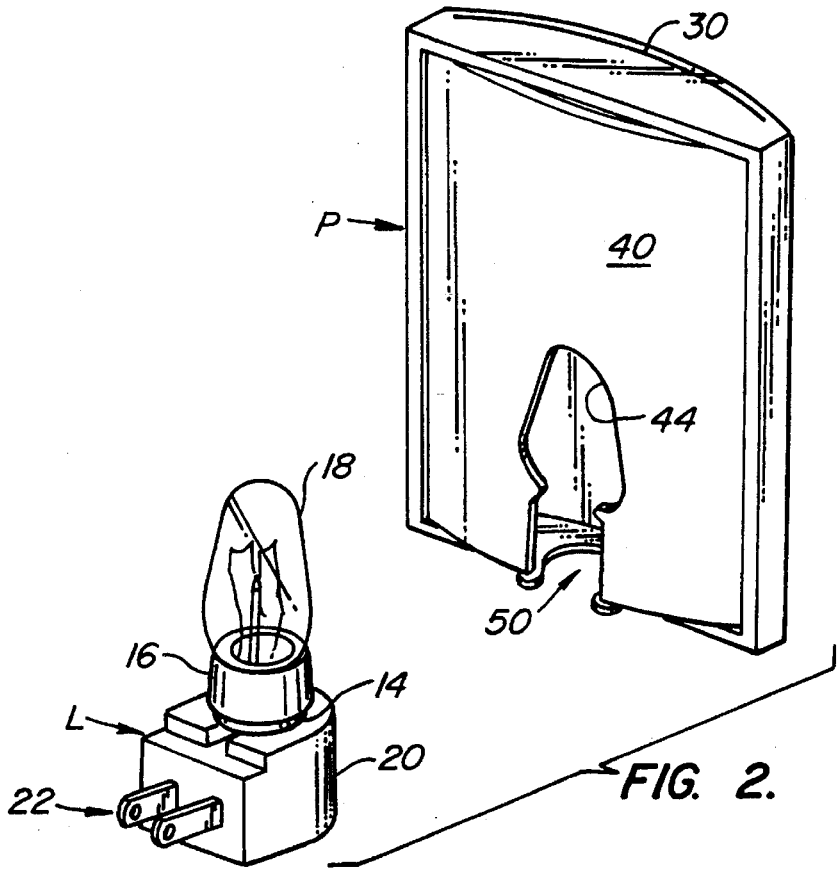

Referring to FIGS. 1 & 2, picture holder P is disclosed for bayonet connection to standard right angle wall plug mounted night light L. As can be seen clearly in FIG. 2, standard right angle wall plug mounted night light L has an annular indentation 14 on light socket 16 to which flame shaped bulb 18 is mounted. Light socket 16 mounts on base 20 from which standard Edison connectors 22 protrude. It will be understood that standard right angle wall plug mounted night light L is a standard item of manufacture that incorporates at annular indentation 14 a typically opaque shield. As will be seen, picture holder P mounts to standard right angle wall plug mounted night light L at this annular indentation 14.

Referring to FIGS. 1 and 2, picture holder P includes opaque frame F. Opaque frame F has top 24, sides 26, and bottom 28. Opaque frame F is provided with a transparent convex outwardly exposed arcuate front wall 32. Corresponding arcuate slot 30 in the front top of the opaque frame F provides for insertion and removal of pictures to be displayed. In such insertion, a photograph such as dog photograph 35 is placed over transparent convex outwardly exposed arcuate front wall 32 to provide back illumination to the translucent portions of the photograph.

Opaque frame F is closed in the rear by translucent backing 40. This translucent backing 40 is provided to the frame having an arcuate profile opposite and complimentary to the arcuate transparent profile of the transparent cover. Further, translucent backing 40 has aperture profile 44 to intimately surround the partial profile of flame shaped bulb 18 about which the frame mounts.

Opaque frame F with picture mounted can be inserted to the wall plug mounted flame shaped bulb 18 so that a first portion of the bulb is exposed to the enclosed interior of the frame and a second portion of the bulb is exposed to the wall of a wall mount plug immediately behind the frame. The frame includes as the bottom thereof bayonet connection 50 to the light.

In operation, picture holder P is first provided with a picture and then mounted at the bayonet fitting to the flame shaped bulb 18. The arcuate translucent backing exposes a first half of flame shaped bulb 18 to the frame interior and a second half of the flame shaped bulb 18 to the wall immediately behind the frame. This partial covering of the bulb provides uniform illumination to standard photographs inserted within the frame while casting an attractive light halo around the mounted frame. A translucently illuminated photograph is displayed in an attractively mounted back lit picture frame.

What is claimed is:

1. A picture holder for bayonet connection to a standard right angle wall plug mounted night light having a plug comprising in combination:

an opaque frame having a transparent convex outwardly exposed arcuate front wall connected to a defined frame periphery including a top, two sides, and a bottom of the opaque frame;

the opaque frame defining a slot in the opaque frame permitting insertion and removal of pictures to be displayed;

a backing secured to the opaque frame having an arcuate profile opposite and complimentary to the transparent convex outwardly exposed arcuate front wall of the opaque frame to form an enclosed interior to the opaque frame;

the backing defining a profile intimately surrounding the night light to which the opaque frame mounts whereby the opaque frame with picture mounted can be inserted and secured to the right angle wall plug mounted night light with a first portion of a bulb of the night light exposed to the enclosed interior of the opaque frame and a second portion of the night light is exposed to a wall of a wall mount plug immediately behind the frame; and, the frame including at the bottom thereof the bayonet connection fitting to the night light.

2. A picture holder for bayonet connection to a standard right angle wall plug mounted night light according to claim 1 comprising:

the opaque frame defining a slot in the opaque frame defines the slot at the top of the opaque frame.

3. A picture holder for bayonet connection to a standard right angle wall plug mounted night light according to claim 1 comprising:

the backing secured to the opaque frame is translucent.

* * * * *